US008860561B2

(12) United States Patent
Ellis et al.

(10) Patent No.: US 8,860,561 B2
(45) Date of Patent: Oct. 14, 2014

(54) METHOD AND APPARATUS FOR DISTRIBUTED LIGHTING CONTROL

(75) Inventors: Todd Ellis, Morrisville, NC (US); Christopher Atkins, Wake Forest, NC (US); Bobby Cantrell, Staunton, VA (US)

(73) Assignee: Sensus USA Inc., Raleigh, NC (US)

( * ) Notice: Subject to any disclaimer, the term of this patent is extended or adjusted under 35 U.S.C. 154(b) by 265 days.

(21) Appl. No.: 13/360,072

(22) Filed: Jan. 27, 2012

(65) Prior Publication Data

US 2012/0194352 A1 Aug. 2, 2012

Related U.S. Application Data

(60) Provisional application No. 61/437,129, filed on Jan. 28, 2011.

(51) Int. Cl.

*H05B 39/00* (2006.01)
*H05B 37/03* (2006.01)
*H05B 37/02* (2006.01)

(52) U.S. Cl.

CPC ..... *H05B 37/034* (2013.01); *H05B 37/0272* (2013.01)
USPC ..... 340/332; 315/294; 340/3.5; 340/309.16; 340/907; 340/944

(58) Field of Classification Search

CPC ..... G08B 7/062; G08B 7/066; B60W 50/14; G08G 1/164; G08G 1/09; H05B 37/034; H05B 37/029; H05B 37/0263; H05B 37/0245; Y02B 20/72
USPC ..... 340/641, 691.1–691.4, 691.8, 331, 332, 340/309.16, 3.5, 9.1, 907, 944; 702/182–185, 188; 307/38; 315/294, 315/312

See application file for complete search history.

(56) References Cited

U.S. PATENT DOCUMENTS

| | | | | |
|---|---|---|---|---|
| 4,994,718 | A * | 2/1991 | Gordin | 315/240 |
| 5,815,068 | A * | 9/1998 | Vadseth | 340/691.2 |
| 2,898,384 | A | 4/1999 | Alt et al. | |
| 7,688,222 | B2 * | 3/2010 | Peddie et al. | 340/332 |
| 2006/0044152 | A1 * | 3/2006 | Wang | 340/825 |
| 2006/0139161 | A1 * | 6/2006 | Beghelli | 340/514 |
| 2009/0009089 | A1 * | 1/2009 | Burkett | 315/82 |
| 2010/0127642 | A1 * | 5/2010 | Chen | 315/312 |
| 2010/0271178 | A1 * | 10/2010 | Ahmad | 340/10.1 |
| 2011/0215735 | A1 * | 9/2011 | Herbst et al. | 315/297 |

FOREIGN PATENT DOCUMENTS

WO 2004/023849 A1 3/2004

* cited by examiner

*Primary Examiner* — Thomas Mullen
(74) *Attorney, Agent, or Firm* — Murphy, Bilak & Homiller, PLLC

(57) ABSTRACT

In one aspect, the present invention provides control for a distributed lighting network, for selectively reducing an aggregate electrical load of the distributed lighting network according to a defined lighting reduction pattern. Among the several advantages of the provided control is the ability to define via the pattern which lamps are involved in load shedding, and how they are controlled to shed load. In another aspect, the present invention provides control for a distributed lighting network, for visibly signaling persons within sight of one or more lamps within the distributed lighting network. Among the several advantages of the provided control is the ability to provide emergency or other public safety signaling to persons that might not otherwise be alerted to an existing or impending danger.

19 Claims, 5 Drawing Sheets

METHOD AND APPARATUS FOR DISTRIBUTED LIGHTING CONTROL

RELATED APPLICATIONS

This application claims priority under 35 U.S.C. §119 from the U.S. provisional patent application filed on 28 Jan. 2011 and assigned application Ser. No. 61/437,129, and that prior application is expressly incorporated herein by reference.

TECHNICAL FIELD

The present invention generally relates to lighting control, and particularly relates to distributed lighting control.

BACKGROUND

Street lighting has long been used to provide nighttime lighting, for reasons of safety, convenience, utility, and aesthetics. Common examples include the network(s) of pole-mounted lights commonly used both for surface streets and at least some portions of interstates and freeways. Other common examples include the lighting systems, pole-mounted or otherwise, that are used to illuminate parking lots, parking garage decks, neighborhoods, etc.

These lighting networks, generally comprising a plurality of spaced-apart lighting units, represent potentially significant electrical loads. Further, in addition to such direct operating expenses, the expense and effort associated with monitoring and maintaining lighting networks, particularly large lighting networks, are well known.

Some degree of automation, at least with respect to monitoring lamp status, for example, is known. For example, it is known to deploy lamp units that include some type of monitoring and communication circuitry capable of reporting lamp status back to a central monitoring station. Various communication mechanisms are used for such reporting, including power line signaling, wherein communications are carried at least partway over the electrical supply lines used to power the lamp modules. Further, there are products that provide some wireless capability for lighting networks, such as for detecting failed units, etc.

SUMMARY

In one aspect, the present invention provides control for a distributed lighting network, for selectively reducing an aggregate electrical load of the distributed lighting network according to a defined lighting reduction pattern. Among the several advantages of the provided control is the ability to define via the pattern which lamps are involved in load shedding, and how they are controlled to shed load.

In another aspect, the present invention provides control for a distributed lighting network, for visibly signaling persons within sight of one or more lamps within the distributed lighting network. Among the several advantages of the provided control is the ability to provide emergency or other public safety signaling to persons that might not otherwise be alerted to an existing or impending danger. Non-limiting examples including "runway flashing" of streetlights—timed, successive blinking—along one or more roadways, to indicate evacuation routes and directions of travel to motorists.

Correspondingly, in one embodiment, the present invention comprises a lighting control server configured to control a distributed lighting system comprising a plurality of physically distributed lamps, where each lamp is controllable through a wireless lamp control module. The lighting control server comprises a communication interface configured to communicatively couple the lighting control server to a regional network interface (RNI) that in turn communicatively couples to a radio network providing two-way radio links with the lamp modules. Further, the lighting control server includes a control circuit operatively associated with the communication interface and configured to selectively reduce an aggregate electrical load of the distributed lighting system. In particular, in one or more embodiments, the control circuit is configured to determine a set of lamps within the distributed lighting system to place into a reduced-consumption state according to a defined lighting reduction pattern, and to send lighting control commands to the wireless lamp control modules associated with said set of lamps, to effectuate the defined lighting reduction pattern in said distributed lighting system.

In another embodiment, the present invention comprises a method of lighting control for a distributed lighting system comprising a plurality of physically distributed lamps, each lamp controllable through a wireless lamp control module. In an example implementation, the method comprises selectively reducing an aggregate electrical load of the distributed lighting system by: determining a set of lamps within the distributed lighting system to place into a reduced-consumption state according to a defined lighting reduction pattern; and sending lighting control commands to the wireless lamp control modules associated with said set of lamps, to effectuate the defined lighting reduction pattern in said distributed lighting system.

In another embodiment, the present invention comprises a lighting control server configured to control a distributed lighting system comprising a plurality of physically distributed lamps, where each lamp is controllable through a wireless lamp control module. The lighting control server includes a communication interface configured to communicatively couple the lighting control server to a regional network interface (RNI) that in turn communicatively couples to a radio network providing two-way radio links with the lamp modules. Further, the lighting control server includes a control circuit that is operatively associated with the communication interface.

In an example embodiment, the control circuit is configured to selectively control some or all of the lamps in the distributed lighting system to effectuate a defined signaling pattern, for visibly signaling any people in proximity of said lamps. Here, the control circuit is configured to: determine a set of lamps within the distributed lighting system to use for signaling; and send lighting control commands to the wireless lamp control modules associated with said set of lamps, to effectuate the defined signaling pattern.

In another embodiment, the present invention comprises a method of lighting control for a distributed lighting system comprising a plurality of physically distributed lamps, where each lamp is controllable through a wireless lamp control module. The method comprises selectively controlling some or all of the lamps in the distributed lighting system to effectuate a defined signaling pattern, for visibly signaling any people in proximity of some or all of the lamps. The method achieves this control by: determining a set of lamps within the distributed lighting system to use for signaling; and sending lighting control commands to the wireless lamp control modules associated with said set of lamps, to effectuate the defined signaling pattern.

Of course, the present invention is not limited to the above features and advantages. Indeed, those skilled in the art will recognize additional features and advantages upon reading the following detailed description, and upon viewing the accompanying drawings.

DETAILED DESCRIPTION

Figure 1:
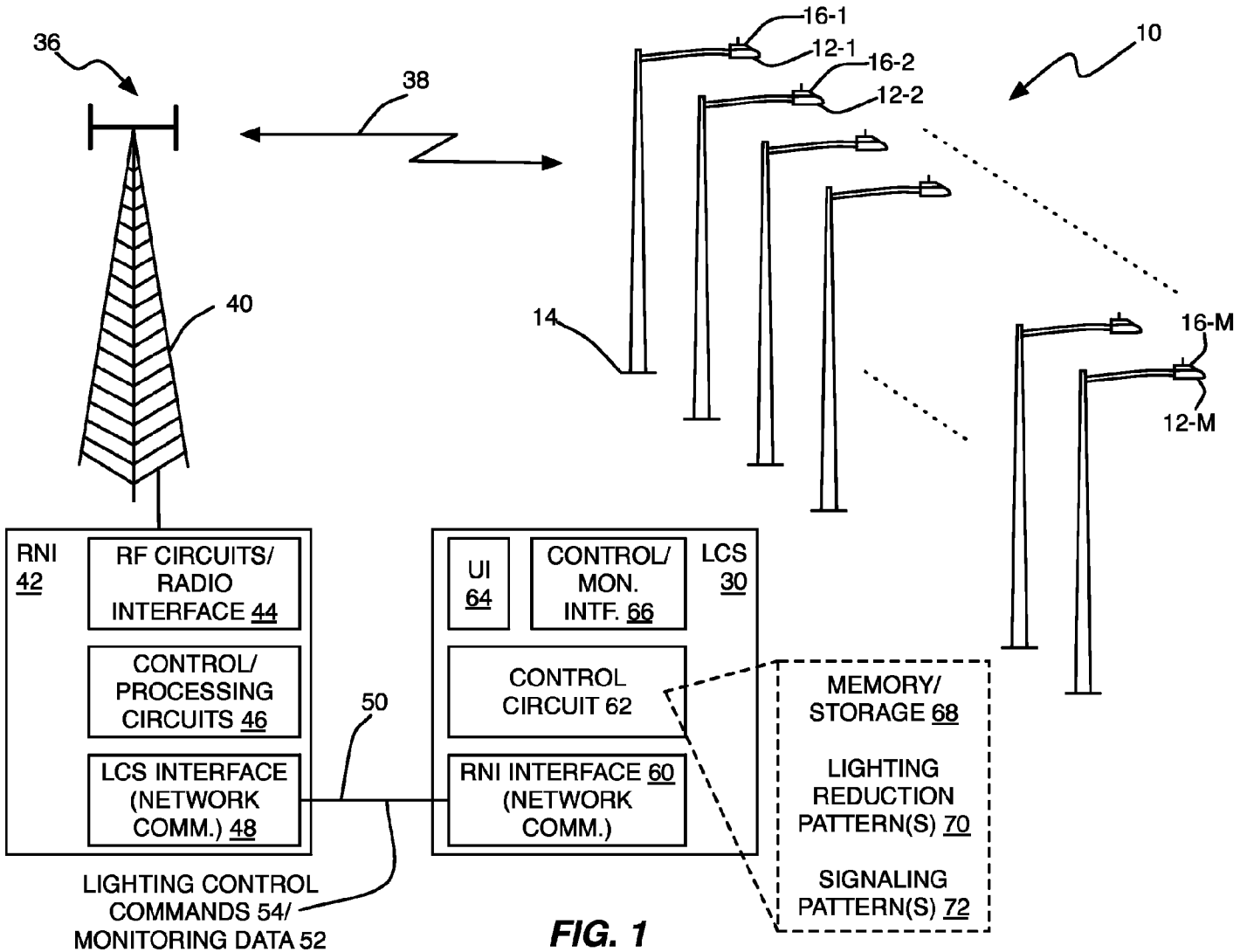
FIG. 1 is a block diagram of one embodiment of distributed lighting system, a radio network, a regional network interface, and a lighting control server.

FIG. 1 is a simplified diagram illustrating one embodiment of a distributed lighting system 10, which includes a plurality of lamps 12. For ease of discussion, the reference number "12" is used for referring to lamps in the plural sense, i.e., "lamps 12," and for generically referring to any given lamp, i.e., "lamp 12." Where helpful for clarity, individual lamps 12 are distinguished using suffix designations, i.e., "12-1," "12-2," and so on.

By way of non-limiting example, the lamps 12 are depicted as being mounted on lamp poles 14 and it will be understood that this configuration complements their use as a system of street lamps, a system of parking lot lights (for one or more parking lots), or other outdoor lighting systems in which a plurality of lamps 12 are positioned or otherwise arrayed at spaced-apart locations within a given area or geographic region. In other contemplated examples, the distributed lighting system 10 comprises a plurality of lamps 12 arrayed within one or more parking garages or the like.

A more notable aspect is the association of a wireless lamp control module 16 with each lamp 12, e.g., wireless lamp control module 16-1 is associated with lamp 12-1, wireless lamp control module 16-2 is associated with lamp 12-2, and so on. For brevity, the wireless lamp control modules 16 are referred to simply as "control modules 16," and in some instances the drawings abbreviate the control modules 16 as "WLCMs."

Figure 2:
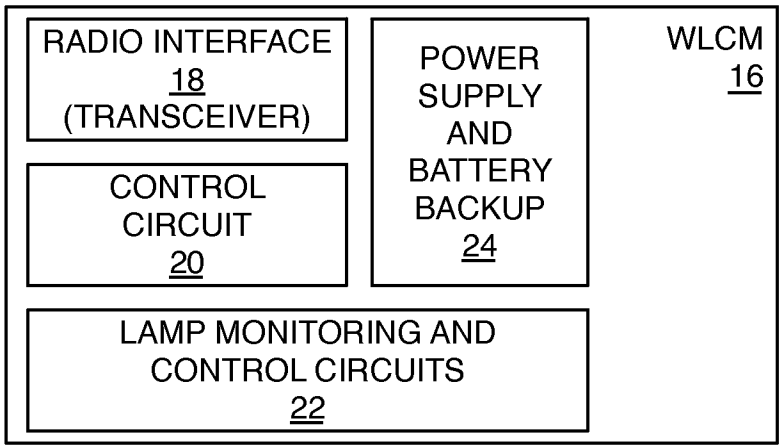
FIG. 2 is a block diagram of one embodiment of a wireless lamp control module that provides for two-way communication with the lighting control server of FIG. 1.

As shown in FIG. 2, the control modules 16 are electronic devices, each including a radio interface 18 (e.g., a transceiver circuit), a control circuit 20 (which may be implemented as a programmed microcontroller and supporting circuitry), lamp monitoring and control circuits 22, along with power supply and battery backup circuits 24. Each control module 16 is individually addressable—e.g., it has a fixed or programmable identifier—that allows commands to be individually addressed to it. The individualized identification also allows each control module 16 to send lamp monitoring data that is uniquely identified, so that the status and condition of individual lamps 12 within the distributed lighting system 10 can be tracked and monitored.

As such, the lamp monitoring and control circuits 22 include, in at least one embodiment, voltage and/or current monitoring circuits and on/off control circuitry. Further, in one or more embodiments, the lamp monitoring and control circuits 22 (alone or in combination with the control circuit 20) are configured to implement more sophisticated lamp control, such as dimming control where the lamp 12 can be commanded to operate at brighter or dimmer levels of illumination. The control module 16 also offers, in at least one embodiment, a blink mode of operation. In this regard, the control module 16 is configured to recognize a "blink" command, which may be parameterized in terms of blink duty cycle and blinking period.

Software and/or hardware timers, such as are provided by the control circuit in one or more embodiments, are used to implement blinking. Further, such timers can be used to implement dimming control by controlling an on/off duty cycle of the lamp 12. Of course, the control module 16 also may implement dimming control by controlling the power applied to the illumination element of the lamp 12. In this regard, it will be understood that the control module 16 is implemented at least to some extent according to the lamp technology used for the lamp 12.

In one embodiment, the control modules 16 are implemented with lamp monitoring and control circuits 22 adapted for High Pressure Sodium (HPS) lamps. In other embodiments, the lamp monitoring and control circuits 22 are adapted for use with Light Emitting Diode (LED) lamps, which may comprise large arrays of high-current LEDs. In still other embodiments, the lamp monitoring and control circuits 22 are adapted for use with Radio Frequency (RF) induction lamps. In the latter two cases, it will be appreciated that the lamp technologies at issue offer instant or near-instant off/on capabilities.

Turning back to FIG. 1, one sees that a lighting control server ("LCS") 30 controls the distributed lighting system 10 based on generating and sending lighting control commands 32 to the control modules 16 associated with the lamps 12 in the distributed lighting system 10. In this regard, a radio network 36 communicatively couples the LCS 30 to the control modules 16 by providing two-way radio links 38—e.g., a downlink or DL and an uplink or UL—to the respective control modules 16. The depiction of the radio network 36 is simplified for ease of illustration and, as such, is shown with one base station 40. It will be appreciated that as a matter of practical implementation the radio network 36 may include multiple base stations 40 dispersed over one or more geographic regions, and that these multiple base stations 40 may be configured in a cellular fashion, as is known. According to the cellular configuration, each base station 40 serves a defined geographic region (cell), where those cells may be configured in an overlapping or adjacent fashion to provide more or less continuous coverage over a larger area.

As an example, the radio network 36 comprises a FLEXNET radio network from the SENSUS USA, Inc. ("Sensus"). FLEXNET radio networks operate in licensed spectrum in the 900 MHz range, with the UL utilizing 901 to 902 MHz and the DL utilizing 940 to 941 MHz. These spectrum allocations are subdivided into multiple narrowband channels, e.g., 25 KHz channels. Individual narrowband channels can be allocated to respective control modules 16, or a set of control modules 16 can be assigned to operate on one or more such channels, while other groups are assigned to other channels. Data is sent on a per-channel basis using Frequency Shift Keying ("FSK"), e.g., 4, 8, or 16FSK, where the data may be "packaged" in messages of a predefined bit length.

The individual control modules 16 send status reports for their respective lamps 12 at timed intervals, with those reports being conveyed by the radio network 36 to a radio network interface ("RNI") 42. The RNI 42, which may be a server or other computer system that is configured with a radio interface 44, receives the RF signaling incoming from the control modules 16 and provides demodulation, etc., thereby providing control/processing circuits 46 with digital messages representing the received control module communications. These messages are provided to the LCS 30 via an LCS interface 48, which may be, for example, a computer network interface accessible via a computer network link 50, such as provided via the Internet or through a private IP network. (Note that the LCS 30 can be co-located with the RNI 42, and the link 50 will be adapted accordingly, e.g., it may be internalized or otherwise localized, such as an Ethernet connection between a server configured with software and data storage implementing the RNI 42 and a server configured with software and data storage implementing the LCS 30.)

FIG. 1 depicts the status reports flowing to the LCS 30 from the control modules 16 as "monitoring data" 52. Of further note, and of particular interest in one or more embodiments disclosed herein, one also sees that the network link 50 also carries lighting control commands 54 from the LCS 30 to the RNI 42, where they are converted into RF signaling and transmitted by the radio network 36 over the radio links 38 to the control modules 16. Because each control module 16 is individually addressable, individual lighting control commands 54 can be generated for (targeted to) a specific control module 16, meaning that the LCS 30 can effect lighting control in the distributed lighting system 10 on a per lamp basis.

Of course, the control module addresses may be configured in terms of net/subnet prefixes or suffixes, allowing the LCS 30 to generate commands that target all or some (e.g., defined sets or zones) of the control modules 16. In this regard, it will be appreciated that given lighting control commands 54 may be broadcast over all or part of the geographic regions spanned by the distributed lighting control system 10, but only those control modules targeted by those lighting control commands 54 will respond. This allows very efficient signaling, such as where one lighting control command 54 controls all or many of the lamps 12, yet preserves the flexibility of per-lamp command signaling.

However, it will be appreciated that these arrangements are non-limiting examples, and other signaling configurations could be used, e.g., using per-lamp dedicated channels such as are known in voice/data cellular systems, etc. Further, while the FLEXNET implementation is a preferred implementation, given its use of licensed spectrum, favorable performance characteristics, and economical implementations, the teachings herein are not limited to FLEXNET.

For example, unlicensed spectrum in the ISM band can be used, with corresponding adaptations at the control modules 16 and in the radio network 36. In such a case, the involved radio circuitry may be configured for frequency-hopping OFDM based communications, for example. Other radio configuration examples include any of the cellular network standards, including IS-95, cdma2000, WCDMA, GSM (which may have particular cost advantages), EV-DO/DV, etc.

Setting aside the particular radio implementation used, in an advantageous embodiment contemplated herein, the LCS 30 is configured to control a distributed lighting system 10 comprising a plurality of physically distributed lamps 12, each lamp 12 controllable through a wireless lamp control module 16. The LCS 30 comprises a communication interface 60 that is configured to communicatively couple the LCS 30 to an RNI 42 that in turn communicatively couples to a radio network 36 providing two-way radio links 38 with the lamp modules 16. Further, the LCS 30 includes a control circuit 62 that is operatively associated with the communication interface 60 and configured to selectively reduce an aggregate electrical load of the distributed lighting system 10.

Here, the control circuit 62 comprises, for example, the CPU and supporting resources (e.g., memory and storage devices), of a computer, such as a WINDOWS-based computer that includes disk or other storage that is configured with one or more computer programs, the execution of which by the CPU configures the computer to operate as the LCS 30. The LCS 30 also includes, in one or more embodiments, a user interface ("UI") 64 and a control/monitoring interface 66. Notably, the RNI interface 60 and the control/monitoring interface 66 may comprise separate interfaces, or may be implemented as the same interface having network-addressed "connections" with the RNI 42 and one or more external devices or systems.

In one example, the control/monitoring interface 66 connects the LCS 30 with an electrical supply or distribution system computer that provides electrical load data and/or control signaling to the LCS 30. The electrical load data comprises, for example, data indicating a loading level of the electrical supply system that powers the distributed lighting system 10. Additionally, or alternatively, the LCS 30 receives "triggering" control signaling indicating, e.g., high loading conditions, for the electrical supply system at issue. As a further addition or alternative, the UI 64 (e.g., keyboard, monitor, etc.) may be configured via LCS software to provide a user interface for receiving triggering control signaling or electrical load data to be acted on by the LCS 30.

Regardless, in one or more embodiments of the LCS 30 the control circuit 62 is configured to selectively reduce an aggregate electrical load of the distributed lighting system 10 based on being configured to: determine a set of lamps 12 within the distributed lighting system 10 to place into a reduced-consumption state according to a defined lighting reduction pattern; and send lighting control commands 54 to the control modules 16 associated with the set of lamps 12, to effectuate the defined lighting reduction pattern the distributed lighting system 10.

FIG. 1 depicts an example case where memory/storage 68 of the LCS 30 stores one or more defined lighting reduction patterns 70. In the same or another embodiment, the LCS 30 stores one or more defined signaling patterns 72, with or without also storing the defined lighting reduction pattern(s) 70. Here, a "lighting reduction pattern" 70 comprises a data value or data structure that is used to determine how a reduction in electrical power consumption by the distributed lighting system 10 is to be achieved.

In an example case, a defined lighting reduction pattern 70 comprises a data file or table that identifies particular control modules 16 (by module ID, for example) that are to be placed into the reduced consumption state, thereby reducing the aggregate electrical load of the distributed lighting system 10. In another example, the defined lighting reduction pattern 70 comprises one or more values representing a generic pattern—e.g., every other lamp 12, every third lamp 12, etc.—that is used by the LCS 30 to determine which lamps 12 in the distributed lighting system 10 are to be placed into a reduced-consumption state, to achieve some desired reduction in the aggregate electrical load.

In yet another example, the LCS 30 dynamically generates or derives the lighting reduction pattern(s) 70 in dependence on the amount of load reduction desired. Thus, more lamps 12 are placed into a reduced-consumption state for a 10% load reduction than for a 5% load reduction.

One aspect of the LCS 30 is that in one or more embodiments, it is configured to intelligently apply or determine the defined lighting reduction pattern(s) 70, to minimize the disruption in lighting. For example, as a matter of public safety, the LCS 30 darkens every other lamp 12 in an urban setting, or ensures that no two lamps 12 on adjacent street corners are darkened at the same time. (In this respect, the LCS 30 may apply different defined lighting reduction patterns 70 during the course of the night, in response to changing electrical load conditions, or according to a programmed schedule. The LCS 30 also may apply different defined lighting reduction patterns 70 to different areas—e.g., more aggressive reduction for sets of lamps 12 in areas not designated as safety-critical and less aggressive reduction for sets of lamps 12 in areas that are so designated.)

In at least one embodiment, the LCS 30 is configured to store or otherwise access geographic location information for each lamp 12 in the distributed lighting system 10—e.g., it may have access to a data file of per-lamp GPS coordinates. In one such embodiment, the LCS 30 further stores or has access to map data and it uses its UI to display one or more maps overlaid with lamp positions. Further, the LCS 30 allows an operator to draw (e.g., via a mouse) shapes or regions overlaid on the displayed map and to identify those lamp positions falling within such regions. Still further, the LCS 30 allows the operator to apply a particular defined lighting reduction pattern 70 to each such region, and the LCS 30 records these pattern-lamp associations. In other embodiments, the LCS 30 receives data from another computer or device, that includes coordinate or region data and corresponding pattern designations, and the LCS 30 determines by lamp position which lamps 12 are associated with which pattern.

In any case, the LCS 30 effectuates the defined lighting reduction pattern(s) 70 across some or all of the lamps 12 in the distributed lighting system 10 by sending appropriately generated/configured lighting control commands 54. For the set or sets of lamps 12 to be controlled to effectuate the defined lighting reduction pattern(s) 70, the LCS 30 generates appropriately addressed lighting control commands 54 and sends them to the control modules 16 that are associated with the set(s) of lamps 12.

The command(s) 54 are in one example "off" commands that command the affected control modules 16 to turn their respective lamps 12 off. In another example, the commands are "dim" commands that command the affected control modules 16 to dim their respective lamps 12. The extent by which the aggregate electrical load of the distributed lighting system 10 is reduced can thus be determined by the number of lamps 12 that are turned off or dimmed. In the case of dimming, further degrees of load reduction control are provided based on controlling the amount of dimming applied. Also note that the LCS 30 may effectuate the defined lighting reduction pattern(s) 70 by sending lighting control commands 54 once, or by sending a series of commands over time, such as to implement changing levels of load reduction, changing patterns, etc.

In one embodiment, the control circuit 62 of the LCS 30 is configured to selectively reduce the aggregate electrical load of the distributed lighting system 10 based on being configured to implement the reduction responsive to receiving control signaling indicating that such reduction is desired. In this context, "selectively reducing" means that the LCS 30 operates the distributed lighting system 10 in a normal mode (e.g., with full illumination) and effectuates the load reduction in response to detecting received control signaling that is interpreted by the LCS 30 as indicating that load reduction is desired. Different control signaling can be defined for different lighting reduction patterns 70, or to signify different desired amounts of load reduction, which are then mapped by the LCS 30 to corresponding lighting reduction patterns 70.

In the same or another embodiment, the control circuit 62 is configured to selectively reduce the aggregate electrical load of the distributed lighting system 10 based on being configured to receive electrical load data for an electrical supply system that powers the distributed lighting system 10. The control circuit 62 determines from that received data that a reduction is required. To do so, it may use one or more defined thresholds of electrical loading relative to a defined electrical supply capacity of the involved electrical supply system. Thus, the LCS 30 may have one or more (secure) data links to an electrical generation station, an electrical distribution network command center, or the like, from which it receives real-time or near real-time electrical load data relevant to the distributed lighting system 10.

As noted, in at least one embodiment, the control circuit 62 is configured to read one or more electronic files, the contents of which represent the defined lighting reduction pattern(s) 70, and to determine the set or sets of lamps 12 to control from the file contents. In an example case, the file contents comprise a listing of lamp module identifiers, or comprise a defined lighting reduction value, the value of which indicates to the LCS 30 the number of lamps 12 within the distributed lighting system 10 that are to be placed into the reduced-consumption state.

In at least one embodiment, a plurality of lighting reduction patterns 70 are defined, each corresponding to a different pattern of lighting reduction for a set of lamps 12 within a particular geographic region, or corresponding to a different amount of electrical load reduction. In at least one such embodiment, the control circuit 62 is configured to select a targeted one of the lighting reduction patterns 70, based on receiving control signaling indicating the targeted lighting reduction pattern 70. In the same or another embodiment, the control circuit 62 is configured to select a targeted one of the lighting reduction patterns 70, based on receiving electrical load data for an electrical supply system that powers the distributed lighting system 10 and determining which one of the lighting reduction patterns 70 to effectuate in dependence on a current level of electrical loading on the electrical supply system, as indicated by the electrical load data, and one or more defined loading thresholds.

Also, as noted, the "reduced-consumption" state for a lamp 12 comprises an off state or a dimmed state. Thus, the LCS 30 generates and sends the one or more lighting control commands 54 to effectuate the defined lighting reduction pattern 70 by sending one or more off commands and/or dim commands (which may be parameterized to indicate the percent dimming desired).

In a case where the reduced-consumption state is the off state, the control circuit 62 is, in at least one embodiment, configured to generate further lighting control commands 54 for at least control module 16 associated with at least one lamp 12 that is adjacent to a lamp 12 that is or will be turned off to effectuate said lighting reduction pattern 70. For example, these further lighting control commands 54 are brighten commands, such that the one or more adjacent lamps 12 partially compensate for the loss of illumination from the lamps 12 that are turned off.

Moreover, in at least one example case, the lighting reduction pattern 70 comprises, for a least one geographically associated series of lamps 12 within the distributed lighting system 10, a pattern of off or dimmed lamps 12. Also, as noted, there may be multiple lighting reduction patterns 70 defined. For example, a first one of the defined lighting reduction patterns 70 is characterized as being most aggressive in terms of lighting reduction, and remaining ones in the defined lighting reduction patterns 70 are incrementally less aggressive.

With such patterns, the control circuit 62 in one or more embodiments is configured to apply different ones of the lighting reduction patterns 70 to different sets of lamps 12 within the distributed lighting system 10 according to defined characterizations of the geographic areas corresponding to those different sets.

Figure 3:
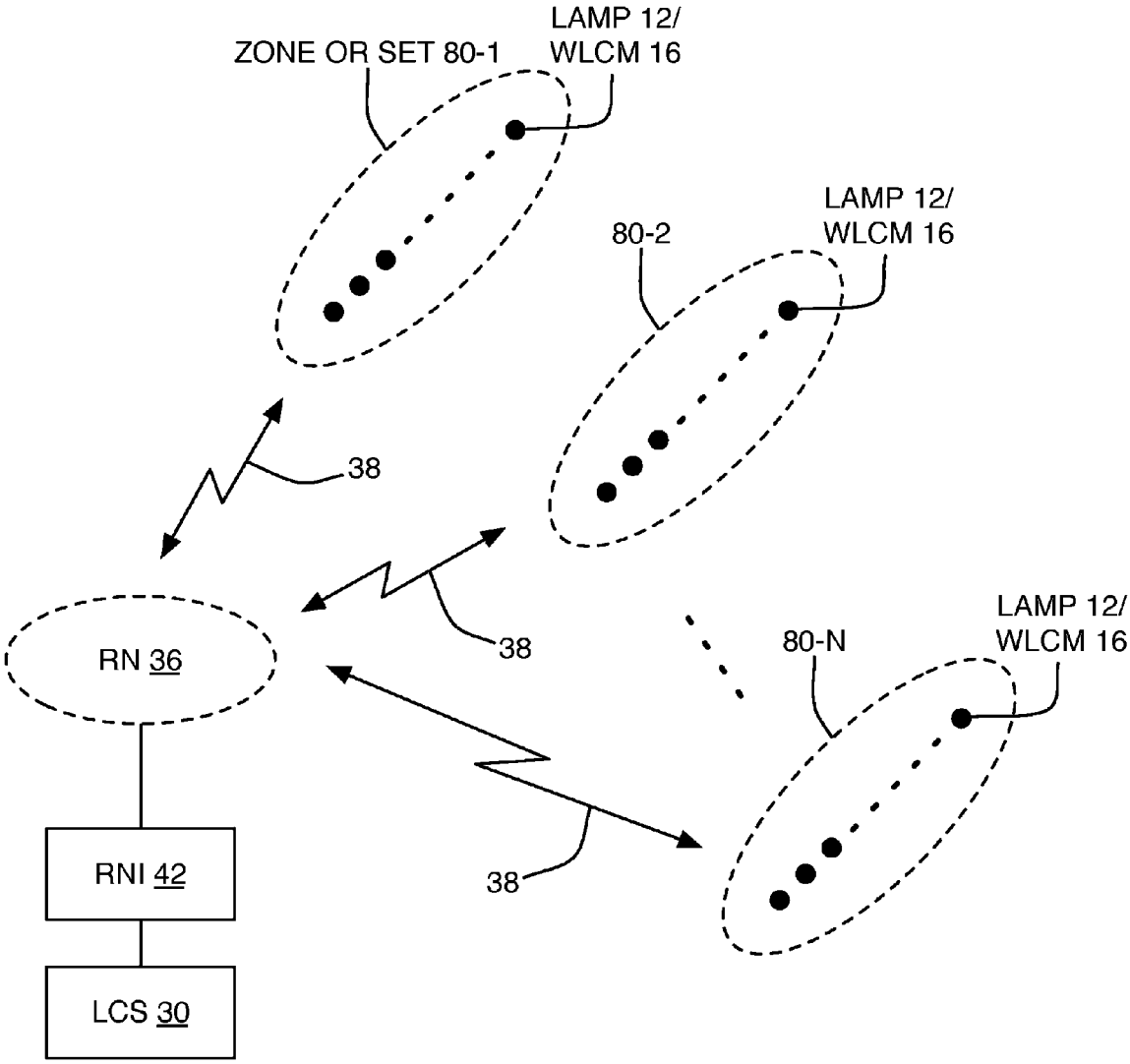
FIG. 3 is a block diagram of a distributed lighting system that is logically divided into one or more zones or sets, e.g., where given zones are associated with different geographic regions.

See, for example, FIG. 3 in which the distributed lighting system 10 comprises a number of zones or sets 80 of lamps 12 (e.g., set 80-1, 80-2, and so on). Each set 80 may be associated with a different geographic region, such as downtown, along surface streets, along highways, in a suburb, etc. As such, each set 80 may be characterized according to the degree to which the provided illumination may be reduced, or in the manner that such reduction is achieved (e.g., no more than two adjacent lamps 12 off, no lamps 12 off, but dimming allowed, etc.). Correspondingly, then, the LCS 30 may apply a particular lighting reduction pattern 70 to each set 80 of lamps 12, based on the characterization associated with that set 80.

In one example, the LCS 30 stores numeric or text values representing the defined characterizations. The actual values may be configured by an operator of the LCS 30, via data input through the UI 64, for example, in accordance with the definitions known to the LCS 30. In any case, each such value is mappable to a defined lighting reduction pattern 70. As such, the control circuit 62 is configured to determine the particular lighting reduction pattern 70 to apply to a particular set 80 of lamps 12 based on mapping the defined characterization stored for the the particular set 80 to the corresponding lighting reduction pattern 70. As one example, five lighting reduction patterns 70 are stored in a table, indexed 0-4. Thus, storing an index value of "3" for set 80-1 causes the LCS 30 to apply the lighting control pattern 70 stored in the table at index position 1. This is to be understood as a non-limiting arrangement, and other mapping functions are contemplated herein.

In addition to the lighting reduction control provided by the LCS 30, or as an alternative to such control, the LCS 30 in at least one embodiment is configured to selectively control all or some of the lamps 12 in the distributed lighting system 10 to effectuate a defined signaling pattern 72 for visibly signaling human observers. In other words, the LCS 30 provides for emergency alerts and/or other signaling via the lamps 12, which can provide safety-critical visual signaling to persons within view of any one or more of the lamps 12.

For example, the distributed lighting system 10 comprises a network of lamps 12 on a college campus or within a business park. In cases where a safety-critical event happens, such as a shooting or the like, an authorized operator can activate a defined emergency signaling pattern using the UI 64 of the LCS 30. Additionally, or alternatively, the LCS 30 can be tied in with one or more emergency networks, such as E911, and can receive pattern activation signaling from such external networks.

In operation, the control circuit 62 determines a set of lamps 12 within the distributed system 10 to use for effectuating the defined signaling pattern 72. A default of all lamps 12 may be used, or only those sets of lamps 12 that are geographically relevant to the event or condition being alerted are chosen. The control circuit 62 generates one or more lighting control commands 54 for the control modules 16 that are associated with the set of lamps 12, wherein the one or more lighting control commands 54 are generated to control the illumination state of individual lamps 12 within the set, to implement the defined signaling pattern 72 across the set of lamps 12. As before, the LCS 30 sends the one or more lighting control commands 54 to the affected control modules 16, to effectuate the defined signaling pattern 72 in the set or sets of lamps 12.

The lighting control commands 54 may be generated from a defined set of lighting control commands comprising one or more of: an off command, an on command, a dim command, a blink command. The LCS 30 sends the selected commands 54 to the control modules 16 associated with the set(s) of lamps 12, to control individual lamps 12 within the set of lamps 12 to effectuate the defined signaling pattern 72. In one or more embodiments, the defined signaling pattern 72 comprises at least one of: a defined blinking pattern and a defined blinking interval. In at least one such embodiment, the LCS 30 is configured to generate the one or more lighting control commands 54 as a timed, repeating series of on and off commands targeted to respective ones of the control modules 16 associated with the set of lamps 12. Properly timed on/off commands provide for the desired blink rate in such cases.

In another case, the defined lighting control commands 54 include a blink command that is recognized by the control modules 16, meaning that only one blink command (rather than a series of on/off commands) need be sent to any given control module 16 to cause its lamp 12 to blink. In such an embodiment, the LCS 30 sends one or more blink commands targeted to respective ones of the control modules 16 associated with the set of lamps 12, to effectuate the defined signaling pattern 72. The LCS 30 may parameterize the blink commands targeting different ones of the lamps 12 in the set, such that an overall blinking pattern or behavior is effectuated across the set of lamps 12, or it may send said one or more blink commands to respective ones of the control modules 16 as a timed sequence of blink commands, such that blinking is initiated at individual lamps 12 according to a timing that effectuates said overall blinking pattern or behavior. In other embodiments, the LCS 30 generates and sends multiple on/off commands according to a timing that effectuates the desired blinking pattern.

In at least one embodiment, the distributed lighting system 10 comprises a system of street lamps 12 distributed along one or more roads, wherein the defined signaling pattern(s) 72 comprise one or more directional indication patterns indicating recommended or mandatory directions of travel along said one or more roads. Such patterns are, for example, reminiscent of runway lighting systems, which indicate landing/taxiing directions of travel using a sequenced blinking along a series or row of lights. Thus, the LCS 30 can be used to indicate that a given two-way road or highway has been re-designated for a single direction of travel.

This is useful for hurricane and other emergency evacuations where, for example, both northbound and southbound lanes of a freeway are used for northbound travel. The directional blinking is also useful for indicating the particular segments of road that are designated for emergency travel, and the blinking pattern can be extended from one road segment to another at intersections and other junctions, to indicate the designated path of evacuation. Thus, in one or more embodiments, the LCS 30 is provisioned with one or more signaling patterns 72 representing desired blinking patterns for street lamps along one or more roads, and the LCS 30 is provisioned with information designating the particular control modules 16 that are associated with these patterns. Of course, the LCS 30 also may be configured to recognize control signaling, operator input, or received data messages, as indicating different types of events, and it may select different signaling patterns 72 in dependence on the event type and/or may apply different signaling patterns 72 to different sets of lamps 12.

Thus, in at least one embodiment, the LCS 30 includes a communication or signaling interface (60 or 66), and is configured to activate a defined signaling pattern 72 responsive to receiving certain data or control signaling. In the same or another embodiment, the distributed lighting system 10 is at least logically divided into multiple zones, and the LCS 30 is configured to effectuate the same or different defined signaling patterns 72 across the multiple zones.

Thus, it will be understood that the LCS 30 in one or more embodiments is configured to implement a method of lighting control for a distributed lighting system 10, wherein the LCS 30 is configured to generate and send lighting control commands 54 to control modules 16 associated with individual lamps 12 within the distributed lighting system 10, to effectuate a defined lighting reduction pattern 70 and/or a defined signaling pattern 72. The defined lighting reduction pattern 70 places some or all of the lamps 12 into a reduced consumption state and thereby reduces the aggregate electrical load of the distributed lighting system 10. The defined signaling pattern 72 imposes a time-varying illumination control at one of more of the lamps 12, such that persons within sight of those lamps 12 are alerted to the existence of an emergency condition or other event.

Thus, in one aspect, this disclosure details methods and apparatuses for selectively turning streetlights on and off for the purpose of electric power load shedding by electric distribution utilities. In at least one implementation, an "overall" system includes a SENSUS FLEXNET radio network comprising at least one FLEXNET base station, a streetlight utilizing an inductive type bulb with ballast, a SENSUS FLEXNET radio module installed inside the streetlight assembly and acting as a control module 12, a SENSUS RNI, and SENSUS LCS software installed on an appropriately configured computer system.

The FLEXNET base station will transmit and receive across a pair of 25 KHz wide channels, typically in the 901-940 MHz Narrowband PCS licensed spectrum band. It will be used to communicate with streetlights equipped with FLEXNET radio modules. The FLEXNET base station is connected via Ethernet links to the RNI, and the RNI passes data bidirectionally through the base station to the street light radio modules. The LCS software interfaces to the RNI and provides instructions to the RNI for passing specific control messages through the base station to the street light radio modules. Likewise, the street light radio modules pass data through the base station to the RNI, and the RNI provides the response information to the LCS 30, for processing in accordance with the logic implemented by the LCS software.

In at least one embodiment, each street light radio module's geospatial location is recorded using a handheld GPS receiver during installation. The location information is recorded in the LCS 30. Based on groupings of geographic locations, the LCS 30 provides for the creation or designation of street light zones or other geographically defined sets of lights within the distributed lighting system 10.

At times of high power consumption demand, zones can be selected and streetlights in those zones can be selectively and instantly turned on or off. Certain zones may be selected for load shedding in areas where little traffic passes during peak consumption times, and others may be left on where traffic safety is more critical. In a preferred embodiment, entire areas are not darkened, but rather certain lamps 12 within a given zone are dimmed or turned off, such that large areas of darkness are not caused by the LCS's load shedding operations. For example, based on geospatial cataloging of street light locations, every second or third light can be selected to remain on for safety reasons. When a street light zone is selected, either all of the lights or an alternating portion of the lights can be turned off via radio control. If the peak consumption time becomes less critical, all lights can instantly be turned back on by the LCS 30 via radio control.

When supervisory control and data acquisition (SCADA) software systems are utilized, a MultiSpeak 4 compatible interface may be used to pass data between the SCADA server and the LCS 30. The SCADA system may have an interface to consumption load metering, and have triggers that indicate an alarm condition requiring intervention. The SCADA operator can select to start a peak generation function, or could alternatively select to initiate a level of load shedding via an interface to the LCS 30. The levels could select any number of street lighting zones, or a specific selection to shed a specific number of streetlights, or all of the streetlights operated by the utility at one time. When the consumption load metering demand passes, a reversal order can be issued through the SCADA system to the LCS to send a message via the RNI 42 to instantly re-light all of the streetlights.

In some sense, similar operations apply in the case of the defined signaling patterns 72. For example, based on geospatial cataloging of street light locations, each streetlight can be targeted for specific signaling. In a first mode, all lights in a specified sector can be set to blink in a pseudo-random method to signify an emergency. Each light's radio module can be sent a message to begin sequencing a one second off, five seconds on cycle. By pseudo-randomly triggering this sequence, not all lights will be off at the same time (to prevent safety issues), but it will be very apparent to the public that an emergency condition exists. Such emergency notifications could be sent to lights at shopping malls, school campuses, or other zoned geographic areas.

Because the lights are geospatially catalogued in one or more embodiments contemplated herein, each light can receive specific instructions to go into "chase" mode. In this mode, each light will be instructed to blink (an off state) based on an instruction message's time stamp. That is, the lighting control commands 54 from the LCS 30 may comprise time-stamped messages. Each of the involved lamp control modules 16 would receive a specific time slot to blink, with the resulting effect being that the position of the turned-off light will appear to move in a specific direction. As previously noted, such a "chase" mode can be used for guiding drivers during evacuations, and could also be used on two directions of one road in order to signify that all lanes are one-way during evacuation or other situations where moving large numbers of vehicles in short periods of time requires one-way routing.

Figure 4:
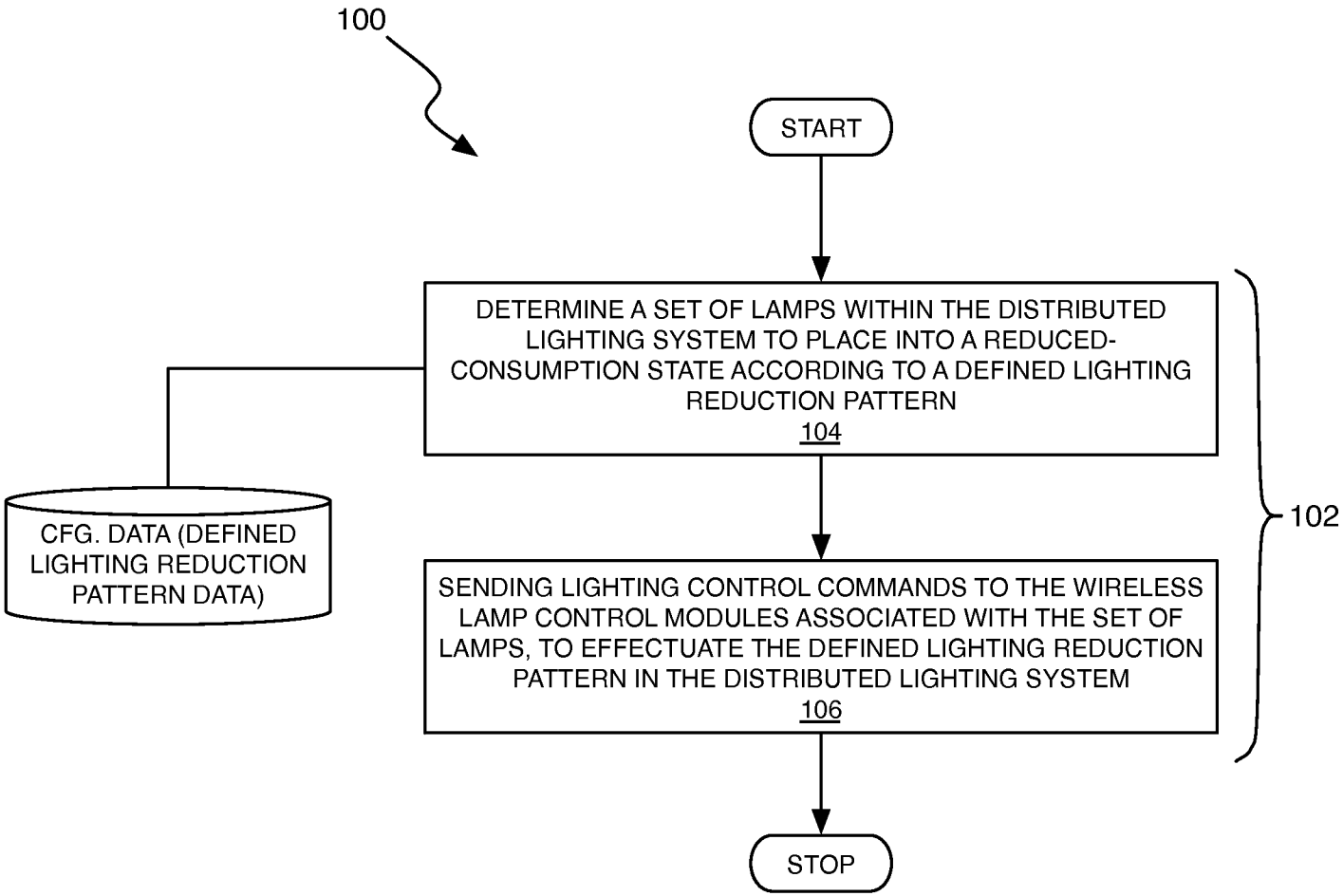
FIG. 4 is a logic flow diagram of a method of distributed lighting control according to one embodiment taught herein.

With the above details in mind, FIG. 4 illustrates one embodiment of a method 100 of lighting control for a distributed lighting system comprising a plurality of physically distributed lamps, where each lamp is controllable through a wireless lamp control module. The method 100 includes selectively reducing an aggregate electrical load of the distributed lighting system (Operation 102). The method 100 performs this operation by determining a set of lamps within the distributed lighting system to place into a reduced-consumption state according to a defined lighting reduction pattern (Block 104), and sending lighting control commands to the wireless lamp control modules associated with said set of lamps, to effectuate the defined lighting reduction pattern in said distributed lighting system (Block 106).

Figure 5:
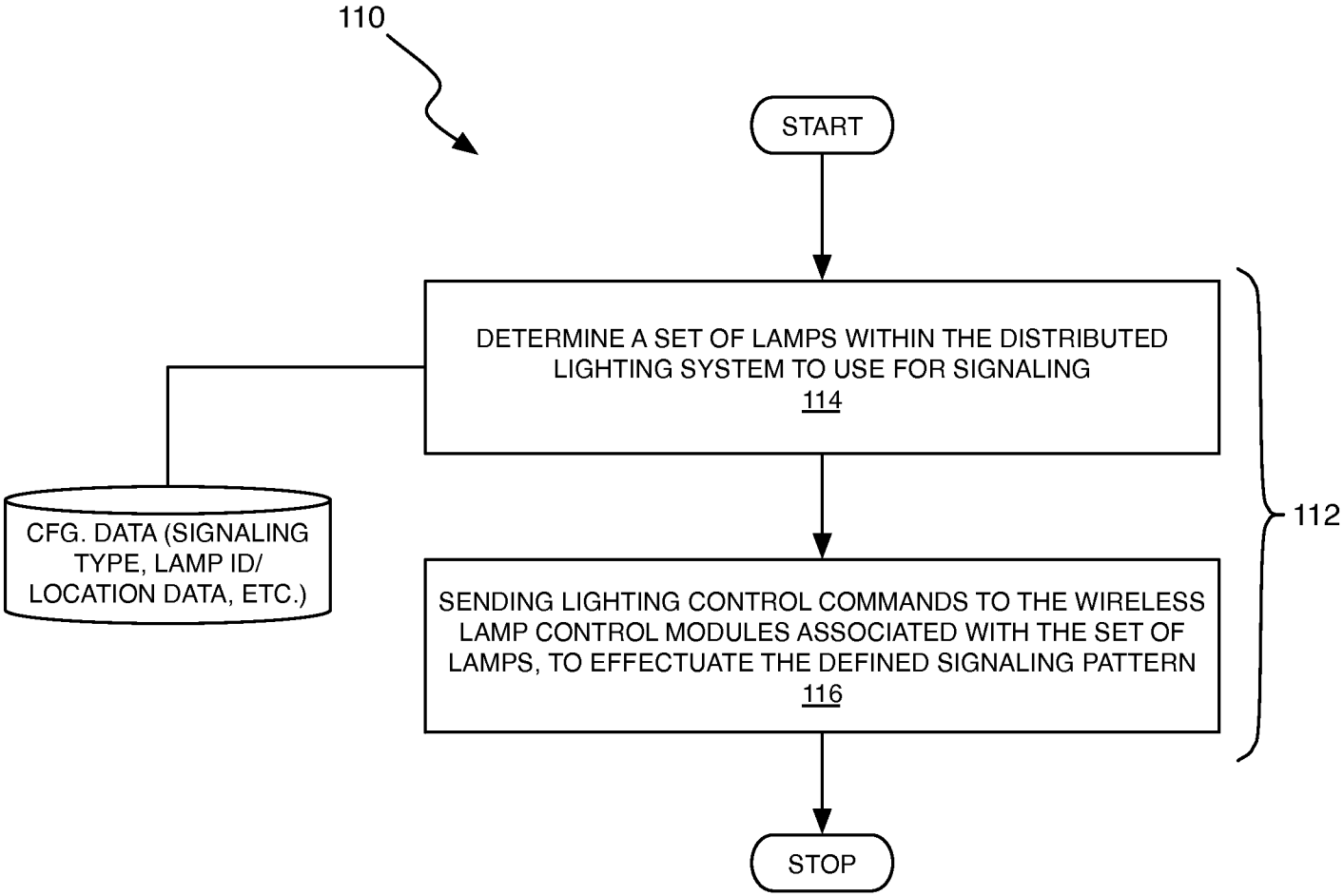
FIG. 5 is a logic flow diagram of a method of distributed lighting control according to another embodiment taught herein.

Similarly, FIG. 5 illustrates another embodiment of a method 110 of lighting control for a distributed lighting system comprising a plurality of physically distributed lamps, where each lamp is controllable through a wireless lamp control module. The method 110 includes selectively controlling some or all of the lamps in the distributed lighting system to effectuate a defined signaling pattern, for visibly signaling any people in proximity of said some or all of the lamps (Operation 112). The method 110 performs this operation determining a set of lamps within the distributed lighting system to use for signaling (Block 114), and sending lighting control commands to the wireless lamp control modules associated with said set of lamps, to effectuate the defined signaling pattern (Block 116).

Of course, modifications and other embodiments of the disclosed invention(s) will come to mind to one skilled in the art having the benefit of the teachings presented in the foregoing descriptions and the associated drawings. For example, it should be understood that in at least one aspect of the teachings herein, a lighting control server (LCS) controls a distributed lighting system based on communicating with wireless lamp control modules that control respective lamps in the system.

In at least one such embodiment, the LCS has a TCP/IP or other communication interface to a Regional Network Interface (RNI) that communicatively couples the LCS to the control modules through a radio network having two-way radio links with the control modules. In this regard, the RNI receives RF signaling from the control modules and processes that signaling to obtain messages from the control modules, for transfer to the LCS, and likewise receives messages from the LCS and generates corresponding radio signaling for transmission to the control modules. Each control module includes its own radio transceiver, to process such receptions and to provide for the aforementioned transmissions.

Thus, in at least one embodiment, the LCS is configured to control a distributed lighting system comprising a plurality of physically distributed lamps, each lamp controllable through a wireless lamp control module. The LCS comprises a communication interface configured to communicatively couple the LCS to a regional network interface (RNI) that in turn communicatively couples to a radio network providing two-way radio links with the lamp control modules. Further, the LCS includes a control circuit operatively associated with the communication interface and configured to selectively reduce an aggregate electrical load of the distributed lighting system based on being configured to: determine a subset of lamps within the distributed lighting system to place into a reduced-consumption state according to a defined lighting reduction pattern; and send lighting control commands to the wireless lamp control modules associated with said subset of lamps, to effectuate the defined lighting reduction pattern in said distributed lighting system.

According to the above embodiment, the LCS provides a centralized control mechanism that provides load shedding on a commanded or autonomous basis, and can perform such shedding according to lighting reduction patterns of essentially any desired degree of sophistication. This allows the LCS to reduce the electrical load represented by the distributed lighting system, balanced against desired illumination considerations, such as public safety, etc. Moreover, the LCS can apply different lighting reduction patterns to different parts of the distributed lighting system, so that more or less aggressive shedding can be applied to the different parts. Similarly, the LCS can dynamically change from one pattern to another, responsive to changing electrical demand conditions, such as indicated by received load data or operator input.

In the same embodiment, or in another embodiment, the LCS is configured to determine the set or sets of lamps to be used for effectuating one or more defined signaling patterns. The LCS is further configured to generate and send the lighting control commands needed to effectuate the defined signaling pattern(s). For example, to indicate a public safety emergency, the LCS causes some or all of the lamps in the distributed lighting system to blink according to a characteristic timing. As another example, the LCS generates lighting control commands that cause a set of lamps in the distributed lighting system to blink in a "chase" pattern that indicates a desired route or direction of travel along one or more road segments.

Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A lighting control server configured to control a distributed lighting system comprising a plurality of physically distributed lamps, each lamp controllable through a wireless lamp control module, said lighting control server comprising:

a communication interface configured to communicatively couple the lighting control server to a regional network interface (RNI) that in turn communicatively couples to a radio network providing two-way radio links with the lamp modules; and a control circuit operatively associated with the communication interface and configured to selectively reduce an aggregate electrical load of the distributed lighting system based on being configured to:

determine a set of lamps within the distributed lighting system to place into a reduced-consumption state according to a defined lighting reduction pattern; and send lighting control commands to the wireless lamp control modules associated with said set of lamps, to effectuate the defined lighting reduction pattern in said distributed lighting system.

2. The lighting control server of claim 1, wherein said control circuit is configured to selectively reduce the aggregate electrical load of the distributed lighting system based on being configured to implement a reduction in the aggregate electrical load responsive to receiving control signaling indicating that said reduction is desired.

3. The lighting control server of claim 1, wherein said control circuit is configured to selectively reduce the aggregate electrical load of the distributed lighting system based on being configured to receive electrical load data for an electrical supply system that powers said distributed lighting system and determine that a reduction in the aggregate electrical load is required based on one or more defined thresholds of electrical loading relative to a defined electrical supply capacity of said electrical supply system.

4. The lighting control server of claim 1, wherein said control circuit is configured to read one or more electronic files, the contents of which represent said defined lighting reduction pattern, and to determine said set of lamps from said contents.

5. The lighting control server of claim 4, wherein said contents of the one or more electronic files comprises a listing of lamp module identifiers, or comprises a defined lighting reduction value, the value of which indicates to said lighting control server the number of lamps within the distributed lighting system that are to be placed into the reduced-consumption state.

6. The lighting control server of claim 1, wherein a plurality of lighting reduction patterns are defined, each corresponding to a different geographical pattern of lighting reduction for all or part of the distributed lighting system, or corresponding to a different amount of electrical load reduction.

7. The lighting control server of claim 6, wherein said control circuit is configured to select a targeted one of the lighting reduction patterns, based upon receiving control signaling indicating the targeted lighting reduction pattern.

8. The lighting control server of claim 6, wherein said control circuit is configured to select a targeted one of the lighting reduction patterns, based upon receiving electrical load data for an electrical supply system that powers the distributed lighting system and determining which one of the lighting reduction patterns to effectuate in dependence on a current level of electrical loading on the electrical supply system, as indicated by the electrical load data, and one or more defined loading thresholds.

9. The lighting control server of claim 1, wherein said reduced-consumption state comprises an off state or a dimmed state, and wherein the control circuit is configured to generate said lighting control commands for the wireless lamp control modules associated with said set of lamps as at least one of an off command or a dim command.

10. The lighting control server of claim 1, wherein said reduced-consumption state comprises an off state, and wherein said control circuit is configured to generate further lighting control commands for at least one wireless lamp control module associated with at least one lamp that is adjacent to a lamp that is or will be turned off to effectuate said lighting reduction pattern, wherein said further lighting control commands are brighten commands, such that said one or more adjacent lamps partially compensate for the loss of illumination from the lamps that are turned off.

11. The lighting control server of claim 1, wherein said lighting reduction pattern comprises, for at least one geographically associated series of lamps within said distributed lighting system, a pattern of off or dimmed lamps within said at least one geographically associated series of lamps.

12. The lighting control server of claim 1, wherein said lighting reduction pattern is one of multiple defined lighting reduction patterns, where a first one of the defined lighting reduction patterns is characterized as being most aggressive in terms of lighting reduction, and remaining ones in the defined lighting reduction patterns are incrementally less aggressive, and wherein the control circuit is configured to apply different ones of the lighting reduction patterns to different sets of lamps within the distributed lighting system according to defined characterizations of the geographic areas corresponding to those different sets.

13. The lighting control server of claim 12, wherein said defined characterizations are stored numeric or text values, each such value mappable to one of said lighting reduction patterns, wherein said control circuit is configured to determine the particular lighting reduction pattern to apply to a particular set of lamps based on mapping the defined characterization stored for the geographic area corresponding to said particular set to the corresponding lighting reduction pattern.

14. A lighting control server configured to control a distributed lighting system comprising a plurality of physically distributed lamps, each lamp controllable through a wireless lamp control module, said lighting control server comprising:

a communication interface configured to communicatively couple the lighting control server to a regional network interface (RNI) that in turn communicatively couples to a radio network providing two-way radio links with the lamp modules; and a control circuit operatively associated with the communication interface and configured to selectively control some or all of the lamps in the distributed lighting system to effectuate a defined signaling pattern, for visibly signaling any people in proximity of said some or all of the lamps, wherein said control circuit is configured to:

determine a set of lamps within the distributed lighting system to use for signaling; and send lighting control commands to the wireless lamp control modules associated with said set of lamps, to effectuate the defined signaling pattern.

15. The lighting control server of claim 14, wherein said lighting control server selectively controls said some or all of the lamps in the distributed lighting system, to effectuate said defined signaling pattern, responsive to receiving an activation command from a network communication interface, or a user interface.

16. The lighting control server of claim 14, wherein said defined signaling pattern comprises a defined blinking pattern, and wherein said lighting control server is configured to send said lighting control commands to effectuate said defined signaling pattern based on being configured to send a timed series of on/off commands to the associated wireless lamp control modules according to a defined blink rate or duty cycle.

17. The lighting control server of claim 14, wherein said lighting control server includes a communication interface that communicatively couples said lighting control server to an emergency services network, and wherein said lighting control server is configured to selectively control said some or all of the lamps in said distributed lighting system, to effectuate said defined signaling pattern, based on receiving pattern activation signaling from said emergency services network.

18. The lighting control server of claim 14, wherein said lighting control server includes data storage containing geographic position information for the lamps within said distributed lighting system, and wherein said lighting control server is configured to receive geographic position or zone selection information and determine from said geographic position or zone information the particular lamps within said distributed lighting system to use for effectuating said defined signaling pattern.

19. The lighting control server of claim 14, wherein said defined signaling pattern is a chase pattern that indicates a direction of travel along one or more pedestrian or vehicle paths, and wherein said lighting control server is configured to send lighting control commands to those lamps running along said one or more pedestrian or vehicle paths, to implement a blinking sequence in those lamps according to said chase pattern.

* * * * *